US011274885B2

(12) United States Patent
Seynat et al.

(10) Patent No.: US 11,274,885 B2
(45) Date of Patent: Mar. 15, 2022

(54) COLLECTOR BOX, SEALING MEANS AND CORRESPONDING HEAT EXCHANGER

(71) Applicant: Valeo Systemes Thermiques, Le Mesnil Saint Denis (FR)

(72) Inventors: Yves Seynat, Reims (FR); Christian Riondet, Reims (FR); Rémi Tournois, Le Mesnil Saint Denis (FR); Jean-Marc Lesueur, Reims (FR); Fabien Bireaud, Le Mesnil Saint-Denis (FR); Xavier Marchadier, Le Mesnil Saint-Denis (FR); José Trindade, Le Mesnil Saint Denis (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 495 days.

(21) Appl. No.: 16/321,696

(22) PCT Filed: Jul. 25, 2017

(86) PCT No.: PCT/FR2017/052063
§ 371 (c)(1),
(2) Date: Jan. 29, 2019

(87) PCT Pub. No.: WO2018/020137
PCT Pub. Date: Feb. 1, 2018

(65) Prior Publication Data

US 2021/0293492 A1 Sep. 23, 2021

(30) Foreign Application Priority Data

Jul. 29, 2016 (FR) ..... 1657373

(51) Int. Cl.
*F28F 9/02* (2006.01)
*F28D 1/053* (2006.01)

(52) U.S. Cl.
CPC ..... *F28F 9/0226* (2013.01); *F28D 1/05366* (2013.01)

(58) Field of Classification Search
CPC ..... F28F 9/0226; F28D 1/05366
(Continued)

(56) References Cited

U.S. PATENT DOCUMENTS 5,345,674 A * 9/1994 Knecht ..... F28D 1/0535 165/173
2011/0168364 A1 7/2011 Okuyama et al.
(Continued)

FOREIGN PATENT DOCUMENTS

DE 102011005168 A1 9/2012
WO 2009101101 A1 8/2009

OTHER PUBLICATIONS

International Search Report and Written Opinion Issued in Corresponding PCT Application No. PCT/FR2017/052063, dated Oct. 13, 2017 (19 Pages with English Translation of International Search Report and Written Opinion).

*Primary Examiner* — Davis D Hwu
(74) *Attorney, Agent, or Firm* — Osha Bergman Watanabe & Burton LLP

(57) ABSTRACT

The invention relates to a heat exchanger collector box (3) including:

Figure 3:
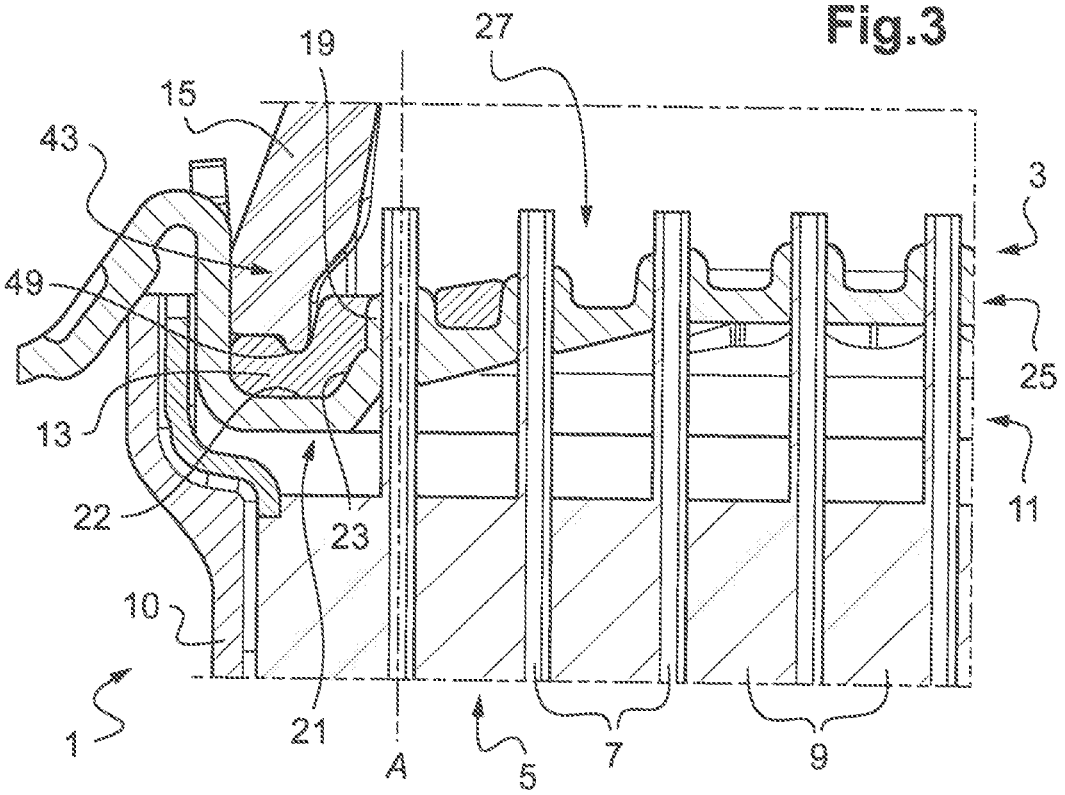

a collector plate (11) having holes respectively lined by collars (19) for passage of ends of heat exchange tubes (7), a sealing means (13), and a cover closing the collector box (3).

According to the invention, the sealing means (13) includes at least one support face (29) and is arranged on the collector plate (11) such that:

(Continued)

the support face (29) is arranged abutting and under tension against one of the collars (19) when the sealing means (13) is assembled with the collector plate (11), and in the compressed state, the sealing means (13) is kept away from the ends of the heat exchange tubes (7) by interposing collars (19) between the sealing means (13) and the ends of said tubes (7).

14 Claims, 4 Drawing Sheets

(58) Field of Classification Search
USPC ..... 165/173
See application file for complete search history.

(56) References Cited

U.S. PATENT DOCUMENTS

| | | | |
|---|---|---|---|
| 2012/0097379 | A1 | 4/2012 | Riondet et al. |
| 2014/0332190 | A1 | 11/2014 | Riondet et al. |

* cited by examiner

Fig.1
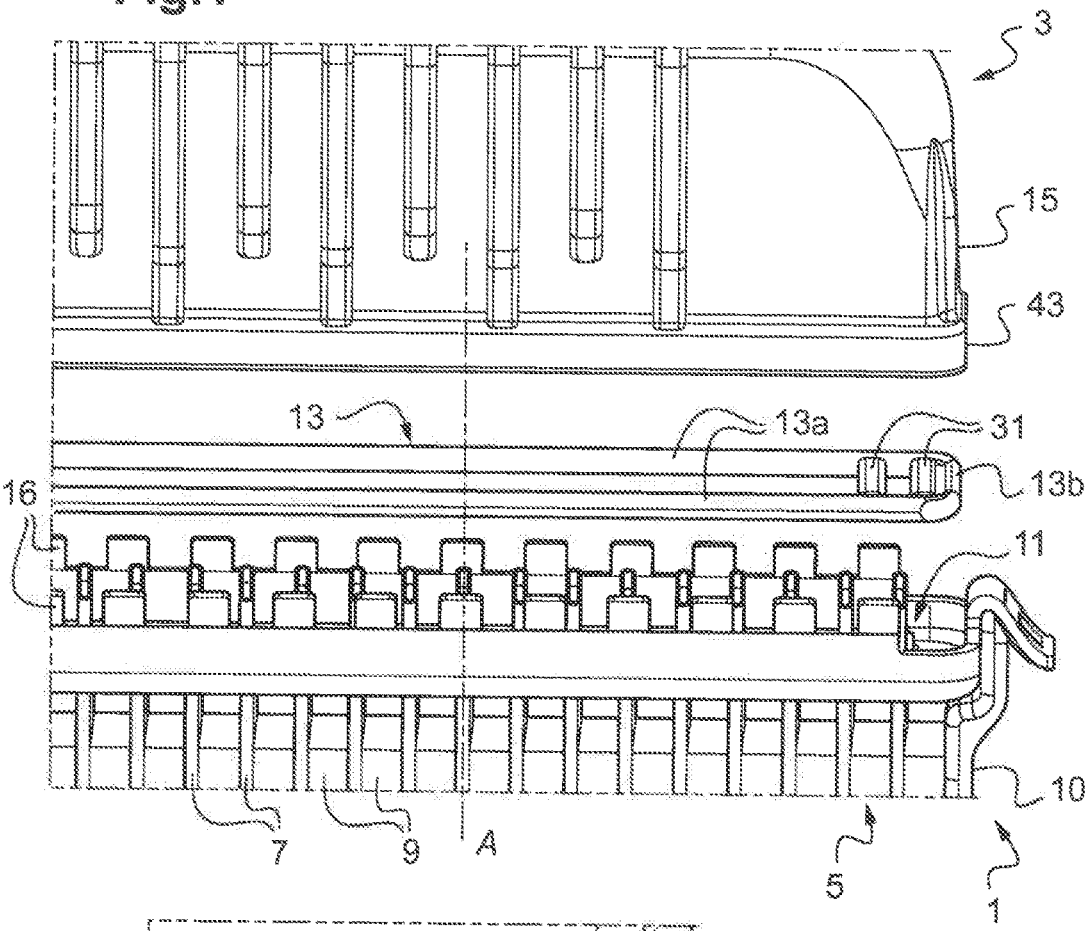
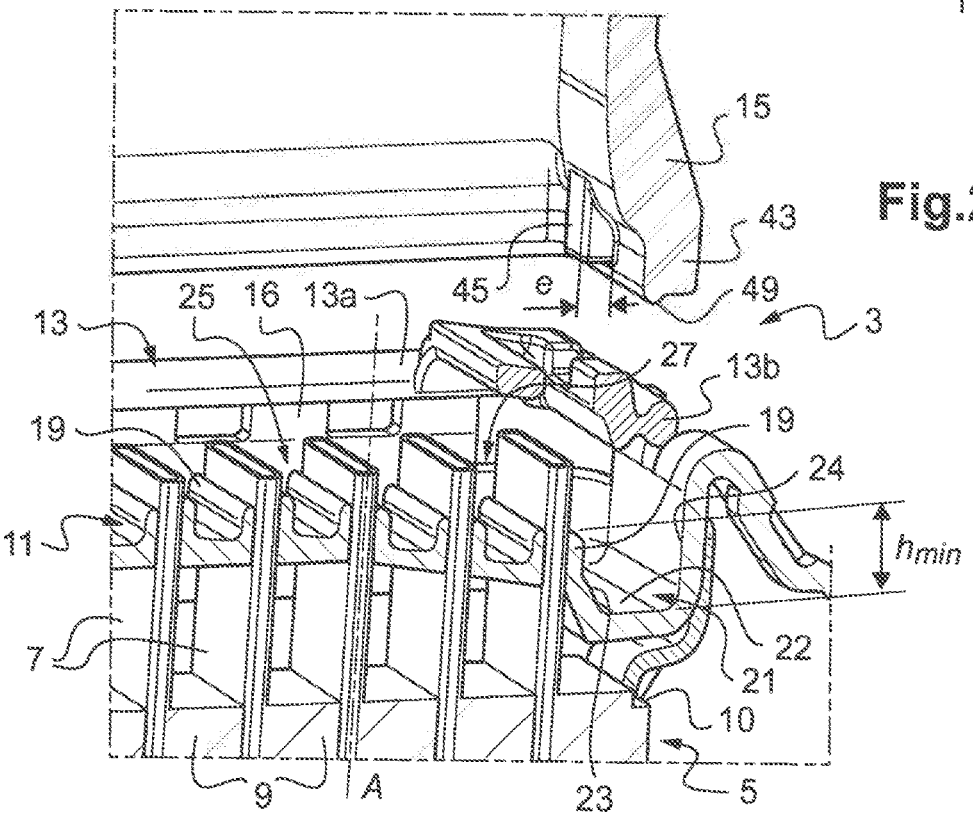
Fig.2

Fig.5
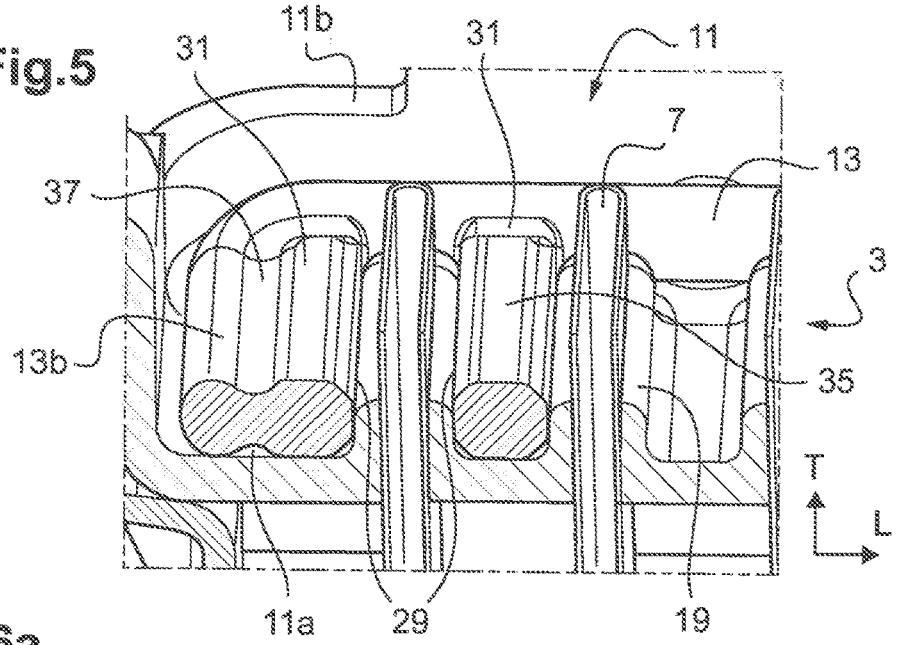
Fig.6a
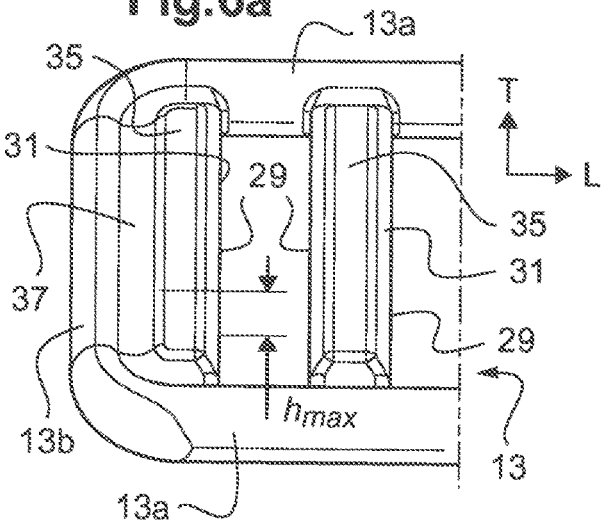
Fig.6b
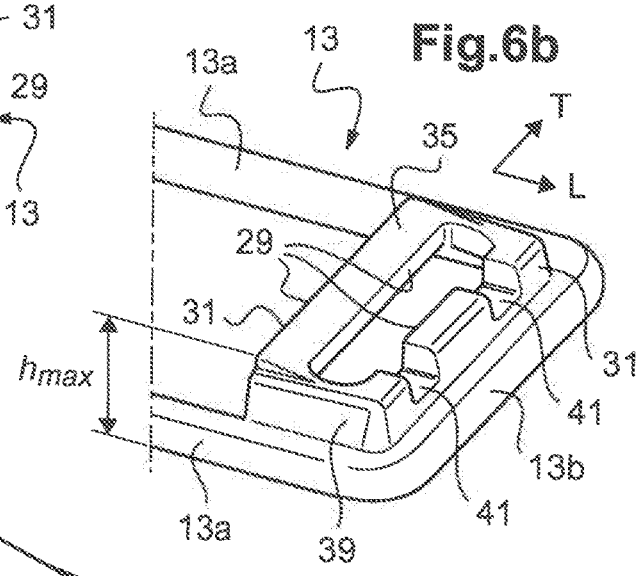
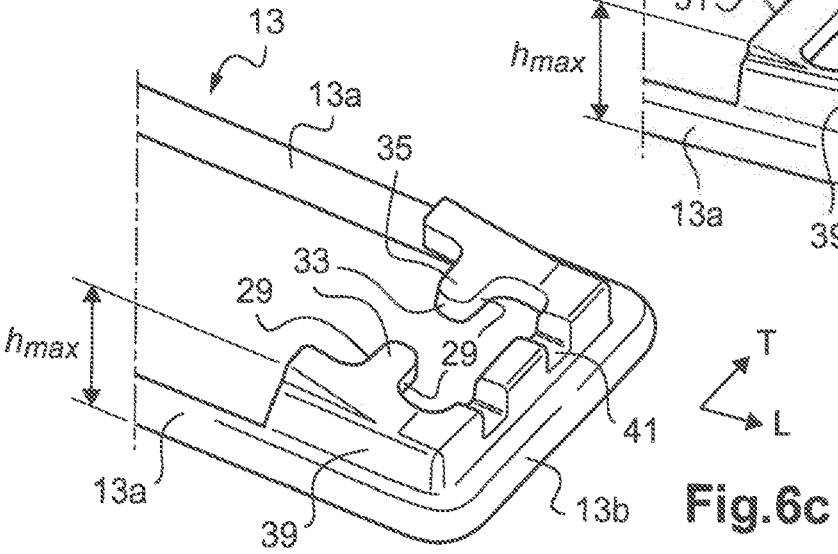
Fig.6c

COLLECTOR BOX, SEALING MEANS AND CORRESPONDING HEAT EXCHANGER

The invention relates to a heat exchanger collector box, in particular for motor vehicle. The invention also relates to a sealing means intended to be arranged in such a collector box. The invention further relates to a corresponding heat exchanger.

Heat exchangers used in motor vehicles are already known, such as radiators for example for cooling the cooling liquid of the engine.

Such a heat exchanger generally comprises a bundle of tubes and fins interleaved between the tubes, and a collector box. This collector box comprises at least two parts: a collector plate accommodating the ends of the tubes and a cover fastened to the collector plate so as to close the collector box while ensuring that a sealing means is compressed.

According to a known solution, the collector plate includes a groove or slot intended in particular to facilitate the positioning and holding in place of the sealing means. The cover is then positioned on the sealing means, and then the cover is fastened to the collector plate so as to close the collector box.

As a variant, collector plates called flat collector plates are known, having no groove or slot, in particular at their periphery. The term "flat collector plate" means that this collector plate extends along a single flat face, except for conventionally protuberant collars for accommodating the ends of the tubes. The cover compresses and holds the sealing means in position on the bottom of the flat collector plate.

According to these known solutions, the sealing means is in contact with the ends of the heat exchange tubes emerging inside the collector box. However, when the sealing means is compressed by fitting the cover, the sealing means in turn exerts pressure, in particular against the ends of the first and last heat exchange tubes of the heat exchange bundle. In particular, in the case of a heat exchanger assembled by brazing, the heat exchange tubes are thin and the ends of the tubes, in particular the first and the last tubes, which are in contact with the sealing means, can be deformed as a result of the pressure exerted by the sealing means.

The aim of the invention is to remedy at least partially these problems of the prior art by proposing a collector box comprising a sealing means whose arrangement is optimized so as to reduce the risk of deformation of the ends of the heat exchange tubes emerging in the collector box.

For this purpose, the object of the invention is a heat exchanger collector box including:

- a collector plate having a plurality of holes respectively lined by collars for passage of the ends of a plurality of heat exchange tubes,
- a compressible sealing means disposed on the peripheral contour of the collector plate, and
- a cover closing the collector box by compressing the sealing means.

According to the invention, the sealing means includes at least one support face and is arranged on the collector plate such that:

- said at least one support face is arranged abutting against one of said collars when the sealing means is assembled with the collector plate, the sealing means furthermore being configured to be under tension on the collector plate via the support face, and
- the sealing means in the compressed state of the sealing means is kept away from the ends of the heat exchange tubes by interposing collars between the sealing means and the ends of said tubes.

According to an aspect of the invention, said at least one support face is configured to abut only against said collar and the sealing means is configured to be exempt of any contact with the ends of the heat exchange tubes.

This makes it possible to prevent the ends of the heat exchange tubes being deformed by pressure of the sealing means when the heat exchange tubes are inserted in the collector box and when the cover is assembled to the collector plate.

Furthermore, the sealing means being under tension on the collars via the at least one support face, this makes it possible to hold the positioning of the sealing means with the collector plate when assembling the collector box and thus to prevent the sealing means from becoming easily separated from the collector plate, or being placed in a bad position (for example by kinking, turning, creeping, twisting etc.).

The collector box can furthermore include one or more following characteristics, taken separately or combined:

- at least one support face is arranged against an end collar;
- the collars are protuberant on the collector plate and extend towards the interior of the collector box, and, the sealing means has a maximum height before compression less than or equal to the height at which the collars are arranged on the collector plate. The sealing means therefore does not extend beyond the collars, such that it does not come into contact with the ends of the heat exchange tubes when they pass through the collector plate;
- the collars are protuberant on the collector plate and extend towards the interior of the collector box, and, the sealing means has a maximum height before compression greater than the height at which the collars are arranged on the collector plate, the greater maximum height being determined such that, in the compressed state, the sealing means is kept away from the ends of the heat exchange tubes through the collars. This way, the sealing means does not come into contact with the ends of the heat exchange tubes when the sealing means is compressed;
- the collars are aligned along the same height, for example in the case of a flat collector plate;
- some collars are arranged on the collector plate at different heights, and, the sealing means has a maximum height before compression less than or equal to the height of the least high collar,
- the sealing means has a peripheral part substantially rectangular in shape, and comprises at least one holding portion extending along the transversal direction and having said at least one support face. The holding portions prevent the sealing means from moving or creeping during the different heat cycles of the heat exchanger,
- at least one holding portion having said at least one support face, the holding portion being arranged between two successive collars and has a width substantially equal to the space between the two collars, for example of the order of 2.5 mm to 5 mm;
- said at least one holding portion is made in one piece with the peripheral part of the sealing means. The sealing means is therefore of a simple low cost design;
- at least one holding portion extends transversally so as to connect the two long sides of the sealing means;
- at least one holding portion is made in the form of a lug;

said at least one holding portion has a flat on its upper face opposite the cover;

the collector plate extends along a substantially flat surface except for the collars;

the collector plate comprises a peripheral groove for accommodating at least partially the sealing means;

the cover comprises a cover base;

the cover base has a predefined number of protuberances protruding from the inner wall of the cover base and extending towards the sealing means on the collector plate so as to abut against the sealing means when the collector plate is assembled with the cover. The protuberances on the cover base contribute to holding the sealing means in position and make it possible to prevent the sealing means from moving or creeping during the different heat cycles;

at least one protuberance of the cover base is arranged abutting against said at least one holding portion of the sealing means.

The invention also relates to a sealing means for a collector box such as defined previously. The sealing means comprises a peripheral part substantially rectangular in shape and furthermore comprises at least one holding portion extending along the transversal direction and having at least one support face configured to be arranged abutting against a collar of a collector plate of the collector box when the sealing means is assembled with the collector plate. The sealing means is furthermore elastic so as to be placed under tension on the collector plate via the support face, and said at least one holding portion has a maximum height before compression predefined so as to be less than or equal to the height at which said collar is disposed on the collector plate.

Such a sealing means is therefore compressible and is intended to be arranged in a collector box so as to abut against one or more collars of the collector plate of this collector box without coming into contact with the ends of the heat exchange tubes on assembling the heat exchanger.

The sealing means can furthermore include one or more following characteristics, taken separately or combined:

the sealing means is made in the form of a seal;

the sealing means is elastic;

said at least one holding portion has a width of the order of 2.5 mm to 5 mm;

said at least one holding portion is made in one piece with the peripheral part of the sealing means;

at least one holding portion extends transversally so as to connect the two long sides of the sealing means;

at least one holding portion is made in the form of a lug;

said at least one holding portion has a flat on its upper face opposite the cover.

The invention furthermore relates to a heat exchanger, in particular for motor vehicle, comprising a bundle of heat exchange tubes. According to the invention, the heat exchanger furthermore includes at least one collector box such as described previously, and such that the sealing means includes at least one support face arranged abutting against one of said collars when the sealing means is assembled with the collector plate and is configured to be under tension on the collector plate via the support face, and in the compressed state of the sealing means, is arranged away from the ends of said tubes passing through the collector plate by interposing collars.

A collar is therefore always present between the sealing means and one heat exchange tube end emerging in the collector box.

It is thus ensured in a simple way and without needing any additional part that the sealing means does not transmit any load against the ends of the heat exchange tubes, in particular the end tubes, when assembling the cover to the collector plate, which compresses the sealing means. The ends of the heat exchange tubes are thus prevented from being deformed.

According to an aspect of the invention, the ends of the heat exchange tubes are respectively fastened to two collector boxes.

According to another aspect of the invention, said bundle comprises an alternating stack of heat exchange tubes and heat exchange fins.

According to a preferred embodiment, the heat exchanger is assembled by brazing.

Figure 4:
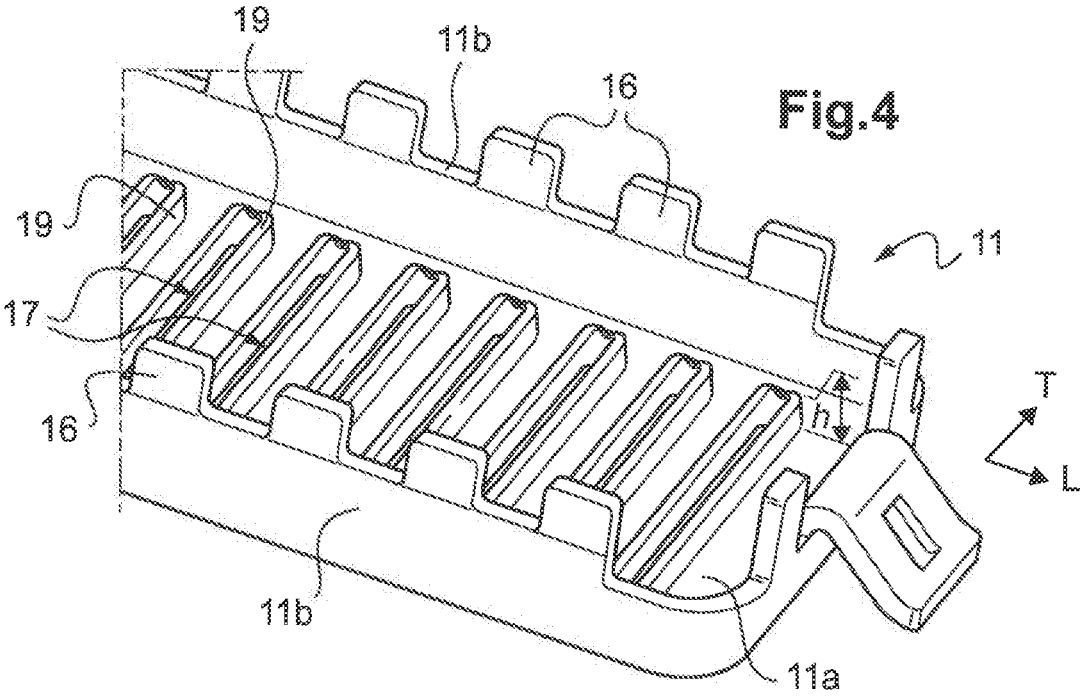
Figure 7:
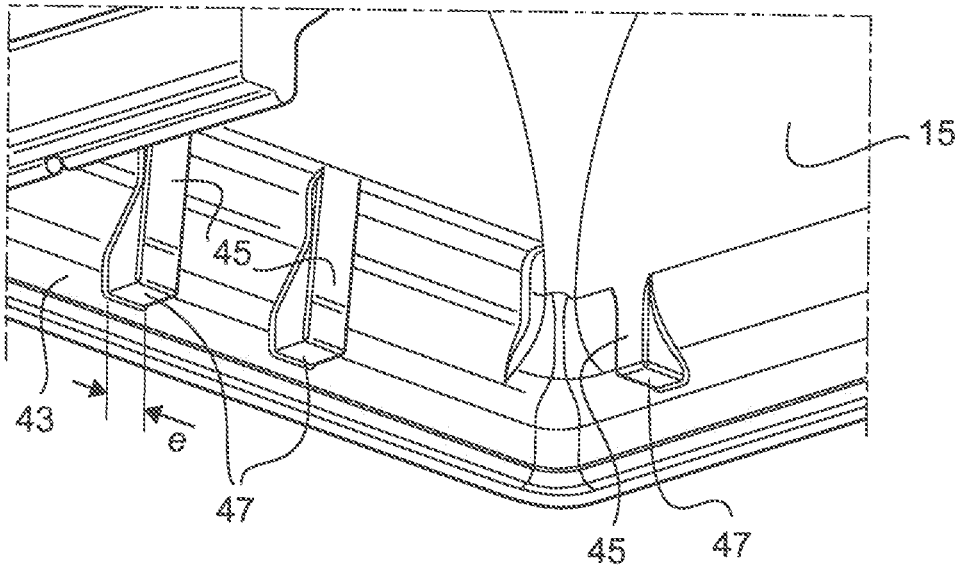
Figure 8:
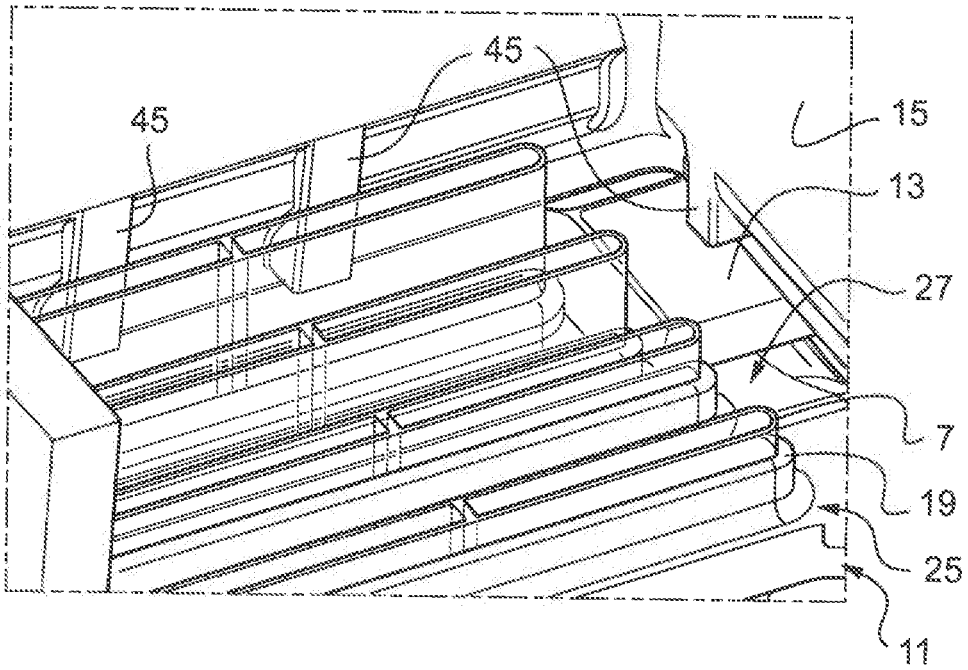

Other characteristics and advantages of the invention will emerge more clearly on reading the following description, given as an illustrative and non-limitative example, and the attached drawings, among which:

FIG. 1 is partial exploded view of a heat exchanger comprising a collector box according to a first embodiment, FIG. 2 is a partial sectional and exploded view of a heat exchanger comprising a collector box according to a second embodiment, FIG. 3 is a partial sectional view showing the heat exchanger of FIG. 2 in the assembled state, FIG. 4 is a partial view in perspective showing a collector plate of the collector box according to the first embodiment, FIG. 5 is a partial sectional view showing a collector plate accommodating a sealing means, FIG. 6*a* is a partial sectional view of a seal according to a first embodiment, FIG. 6*b* is a partial sectional view of a seal according to a second embodiment, FIG. 6*c* is a partial sectional view of a seal according to a variant of the second embodiment, FIG. 7 is a partial view in perspective showing a cover of the collector box of FIG. 1 or 2, and FIG. 8 is partial view showing the interior of the collector box of FIG. 2 in the assembled state.

On these figures, identical elements have the same reference numbers.

The following embodiments are examples. Although the description refers to one or more embodiments, this does not necessarily mean that each reference number refers to the same embodiment, or that the characteristics only apply to just one embodiment. Single characteristics of different embodiments can also be combined or interchanged to provide other embodiments.

On certain figures, a mark L, T corresponding to a horizontal plane is shown, the axis L corresponding to a horizontal axis and the axis T corresponding to a transversal axis.

In the present description, the terms vertical/horizontal or upper/lower are designated in reference to the disposition of the elements on the figures, which generally corresponds to the disposition of the elements in the assembled state in the motor vehicle.

In reference to FIGS. 1 to 3, the invention relates to a heat exchanger 1 for motor vehicle, in particular for cooling the cooling liquid of the engine. Advantageously, the invention applies to a brazed heat exchanger 1, that is to say, whose different elements are assembled by brazing.

The heat exchanger 1 comprises at least one collector box 3, generally two collector boxes 3, the collector box 3 or each collector box 3 making it possible to collect and to distribute a first fluid such as the cooling liquid. More particularly, the invention relates to such a collector box 3.

The heat exchanger 1 additionally comprises a bundle 5 formed by a multiplicity of heat exchange tubes 7, for example in aluminum, arranged as one or more rows of tubes. The heat exchange tubes 7 respectively define one or more channels for the flow of a first fluid, for example, the cooling liquid. As a non-limitative example, the heat exchange tubes 7 are flat tubes. Furthermore, the heat exchange tubes 7 extend respectively along a longitudinal axis A. In this example, the longitudinal axis A is substantially vertical in reference to the disposition of the elements on FIGS. 1 to 3.

Only one end of the heat exchange tubes 7 is visible on FIGS. 1 to 3. According to one embodiment, the ends of the heat exchange tubes 7 are respectively fastened to two collector boxes 3.

The bundle 5 can additionally comprise a plurality of heat exchange fins 9, diagrammatically shown on FIGS. 1 to 3, arranged so as to alternate with the heat exchange tubes 7. The heat exchange fins 9 are advantageously provided so as to perturb the flow of a second fluid such as a flow of air between the heat exchange tubes 7, so as to increase the heat exchange surface between the two fluids.

In this example, the bundle 5 also comprises two lateral cheeks 10 arranged on either side of the stack of heat exchange tubes 7 and heat exchange fins 9. In the case of a brazed heat exchanger 1, these lateral cheeks 10 are assembled by brazing to the rest of the bundle 5.

With more particular regard to the collector box 3, this latter comprises:

- a collector plate 11,
- a sealing means such as a seal 13, and
- a cover 15 closing the collector box 3 by compressing the seal 13.

The collector plate 11, more visible on FIGS. 4 and 5, is made for example in aluminum or aluminum alloy.

The collector plate 11 extends longitudinally along the direction L. The direction T is perpendicular to the direction L, globally in the plane of extension of the collector plate 11.

Fastening means can be provided on the collector plate 11 such as clamping tabs 16 provided to be clamped over the edges of the cover 15.

Furthermore, the collector plate 11 has a plurality of holes 17 for passage of the ends of the heat exchange tubes 7. These holes 17 are respectively lined by collars 19.

According to the embodiments shown, the collars 19 are protuberant relative to the collector plate 11, and extend towards the interior of the collector box 3 when the cover 15 is assembled to the collector plate 11.

According to the first embodiment illustrated on FIGS. 1, 4 and 5, the collector plate 11 can be substantially flat except for the collars 19, that is to say without groove. The collector plate 11 has for example a bottom 11*a*, also called web, substantially rectangular in shape, and edges or sills 11*b*. According to the illustrated example, the edges 11*b* extend substantially perpendicular relative to the bottom 11*a*. These are for example folded edges 11*b*. The fastening means such as the clamping tabs 16 are for example provided on the edges 11*b*.

The holes 17 are situated on the bottom 11*a* of the collector plate 11. In addition, the edges 11*b* make it possible to define a housing for the seal 13 in the same plane as the holes 17. Furthermore according to this embodiment, the collars 19 are for example all at the same height h (see FIG. 4).

According to the second embodiment on FIGS. 2 and 3, the collector plate 11 can comprise a peripheral groove 21 for accommodating at least a part of the seal 13. In this second embodiment, the collector plate 11 also includes edges or sills 11*b*, folded for example, able to have fastening means such as clamping tabs 16.

This peripheral groove 21 has a bottom 22 and two side walls 23, 24 connected by the bottom 22. One of the side walls, also called inner wall 23, is closer to the holes 17 and the collars 19. The opposite side wall 24 or outer side wall 24, that is to say, the one further from the holes 17 and the collars 19, is formed on the edges 11*b* of the collector plate 11. The bottom 22 of the peripheral groove 21 extends for example in a plane substantially perpendicular to the edges 11*b* of the collector plate 11.

Furthermore, the collector plate 11 comprises at least one upper level 25, protuberant relative to the bottom 22 of the peripheral groove 21. The upper level 25 extends for example at a height corresponding to the extension height of the edges 11*b* of the collector plate 11. The upper level 25 therefore extends along a plane, different from and above the plane along which the bottom 22 of the peripheral groove 21 extends in reference to the disposition of the elements on FIGS. 2 and 3. In other words, the upper level 25 is elevated relative to the bottom 22 of the peripheral groove 21. In particular, the upper level 25 extends along a plane parallel to the plane along which the bottom 22 of the peripheral groove 21 extends. The upper level 25 is also called medallion.

At at least one longitudinal end of the collector plate 11, preferably at each longitudinal end, the collector plate 11 can furthermore comprise an intermediate portion 27 connecting the upper level 25 to the peripheral groove 21. In particular, the intermediate portion 27 can be inclined relative to the plane defined by the upper level 25. In this example, the intermediate portion 27 additionally extends at a height evolving relative to the bottom 22 of the peripheral groove 21.

Furthermore, according to a particular embodiment example, at one or at both longitudinal ends of the collector plate 11, the side wall 23 between the bottom 22 of the peripheral groove 21 and the end collar 19, that is to say lining the first or the last hole 17, has a slope. The slope of the side wall 23 is therefore inclined relative to the plane of the opposite side wall 24 and also relative to the plane along which the bottom 22 of the peripheral groove 21 extends. According to the illustrated example, the plane of the side wall 24 is a vertical plane and the plane of the bottom 22 is a horizontal plane in reference to the disposition of the elements on FIG. 1. The slope of the side wall 23 of the peripheral groove 21 extends in the illustrated example along a direction different from the direction of extension of the intermediate portion 27. These am in particular intersecting directions.

According to this second embodiment, the holes 17 lined by collars 19 are arranged on the upper level 25 and the intermediate portion 27. For example, two or three collars 19 are arranged on the intermediate portion 27. The result is that the collars 19 are not all at the same height along the intermediate portion 27. The web of the collector plate 11 comprises the upper level 25 and the intermediate portion 27. In particular, at at least one longitudinal end of the collector plate 11, the end collar 19 is arranged on the intermediate portion 27.

In referring to FIGS. 5 to 6*c*, the sealing means such as a seal 13 is described in more detail. This is a compressible seal 13 disposed on the peripheral contour of the collector plate 11. The seal 13 has a shape complementary to the periphery of the collector plate 11. Here in particular, the seal 13 has a peripheral part substantially rectangular in shape with two opposite long sides 13*a* and two opposite short sides 13*b*. This peripheral part can have, as a non-limitative example, a substantially circular cross section.

This seal 13 is arranged either on the bottom 11*a* of the collector plate 11 (FIG. 5) or in the groove 21 (FIG. 2) when it is provided. In the assembled state of the collector box 3, the seal 13 is arranged between the cover 15 and the collector plate 11, the cover 15 compressing the seal 13 so as to close the collector box 3 while ensuring that the collector box 3 is sealed.

The seal 13 is advantageously elastic and is placed under tension when it is arranged on the collector plate 11.

Furthermore, the seal 13 has at least one support face 29, better visible on FIGS. 5 to 6*c*, configured to abut against one of the collars 19 when the seal 13 is assembled with the collector plate 11. In particular, at least one support face 29 is arranged against an end collar 19 lining the first or last hole 17.

In particular, when it is compressed, the seal 13 only abuts against a collar 19, in particular by its support faces 29, and not against an end of a heat exchange tube 7 emerging inside the collector box 3. The seal 13 has no face configured to abut against the ends of the heat exchange tubes 7. For this purpose, the seal 13 is kept away from the ends of the heat exchange tubes 7 by interposing the collars 19 between the seal 13 and the ends of the heat exchange tubes 7. In other words, a collar 19 is always present between the seal 13, and more precisely the support faces 29, and an end of a heat exchange tube 7.

Thus, in the assembled state of the heat exchanger 1, the seal 13 compressed by the cover is free of any contact with the ends of the heat exchange tubes 7 emerging inside the collector box 3.

According to the described embodiments, the seal 13 comprises at least one holding portion 31, 33 extending along the transversal direction T, that is to say, along the width of the seal 13, in other words along the direction of the short sides 13*b* of the seal 13. In particular, at least one holding portion 31 extends along the transversal direction T between a short side 13*b* of the seal 13 and an end collar 19. The support face or faces 29 of the seal 13 abutting against a collar 19 are formed on these holding portions 31 and/or 33, more precisely on one or either side of the holding portions 31, 33.

According to a first embodiment shown on FIGS. 1, 5 and 6*a*, the holding portions 31 extend substantially in the same plane as the peripheral part 13*a*, 13*b* of the seal 13. Additionally, according to the illustrated example, before the seal 13 is compressed, the holding portions 31 extend over the same height hmax as the peripheral part of the seal 13, which corresponds here to the thickness of the seal 13.

The number of holding portions 31, 33 and their location can be adjusted according to the needs. At least one holding portion 31 is preferably provided such that its support face 29 abuts against an end collar 19.

For example, at least one holding portion 31 can be adjacent to a short side 13*b* of the seal 13. According to the illustrated example, a reduction of thickness can be envisaged at the junction 37 between the short side 13*b* and the holding portion 31.

One or more holding portions 31 can be transversal portions or transversal straps 31 extending so as to connect the two opposite long sides 13*a* of the seal 13, the sealing means then having a general ladder shape whose rungs are formed by the transversal straps. The width of a transversal strap 31 is substantially equal to the width between two successive collars 19. As a non-limitative example, the width of a transversal strap 31 is of the order of 2.5 mm to 5 mm.

These holding portions 31 have for example a flat 35 on their upper face arranged opposite the cover 15 in the assembled state of the collector box 3.

As a variant or addition, it is also possible to provide one or more lugs extending from a long side 13*a* towards the opposite long side 13*a* without reaching it.

Only one longitudinal end of the seal 13 is visible on the figures. It is of course possible to envisage that the seal 13 is configured in a similar way to its other longitudinal end with one or more transversal holding portions 31. In particular, the seal 13 can be symmetrical relative to a median plane.

The seal 13 according to this first embodiment is adapted to be arranged on the substantially flat collector plate 11 according to the first embodiment described in reference to FIGS. 1, 4 and 5.

According to a second embodiment shown on FIGS. 2, 6*b* and 6*c*, the holding portions 31, 33 are elevated relative to the peripheral part 13*a*, 13*b* of the seal 13. In this case, the connecting parts 39 connect the holding portion or portions 31, 33 to the peripheral part 13*a*, 13*b* of the seal 13.

In a way similar to the first embodiment, one or more holding portions 31 can be transversal portions 31 also called transversal straps. In this case, the transversal portions 31 extend so as to connect the two connecting parts 39, respectively connected to a long side of the 13*a* of the seal 13.

As a variant or addition, one or more holding portions 33 can be made in the form of lug 33 extending, from a connecting portion 39 connected to a long side 13*a*, towards the opposite connecting portion 39 connected to the other long side 13*a*, without reaching this portion, as illustrated on FIG. 6*c*.

In particular, at least one holding portion 31 is adjacent to a short side 13*b* of the seal. According to the examples illustrated on FIGS. 6*b* and 6*c*, this is a transversal portion or strap 31 having one or more recesses 41 for cooperating with the cover 15 as will be described later in more detail.

In a way similar to the first embodiment, the holding portions 31 and/or 33 can also have a flat 35 on their upper face arranged opposite the cover 15 in the assembled state of the collector box 3.

As previously, only one longitudinal end of the seal 13 is visible on the figures. It is of course possible to envisage that the seal 13 is configured in a similar way to its other longitudinal end with one or more transversal holding portions 31 and/or 33, and in particular, the seal 13 according to this second embodiment can be symmetrical relative to a median plane.

The seal 13 according to this second embodiment is adapted to be arranged at least partially in the peripheral groove 21 of the collector plate 11 according to the second embodiment described in reference to FIGS. 2, 3, 6*b* and 6*c*.

According to the first or the second embodiment, the holding portions 31 and/or 33 are advantageously made in one piece with the peripheral part 13*a*, 13*b* of the seal 13. So as to further simplify the production of such a piece, the peripheral part 13*a*, 13*b* and the holding portions 31 and/or 33 can be made in one material.

Furthermore, the seal 13 according to either one of the embodiments, and in particular, the holding portion 31, 33 or each holding portion 31, 33 preferably has a maximum height hmax (FIGS. 6*a* to 6*c*) before compression less than or equal to the height h at which the collars 19 (FIG. 4) are disposed on the collector plate 11, said height h is generally substantially identical for all the collars of a flat collector plate. The maximum height hmax corresponds in particular to the limit height of the holding portions 31, 33 (which can be elevated relative to the peripheral part 13*a*, 13*b*) relative to the bottom 11*a* of the collector plate 11. According to the first embodiment, this maximum height hmax corresponds to the height of the peripheral part 13*a*, 13*b* of the seal 13, which corresponds to the height of the holding portions 31.

In the case where the collars 19 are not all of the same height as according to the second embodiment, the seal 13 can have a maximum height hmax before compression less than or equal to the height hmin of the least high collar 19 (see FIG. 2). According to the illustrated second embodiment, the maximum height hmax corresponds to the limit height, relative to the bottom 22 of the collector plate 11, of the holding portions 31, 33 (which are elevated relative to the peripheral part 13*a*, 13*b*). The least high collar 19 in turn is the end collar 19 arranged at the beginning of the intermediate portion 27, that is to say nearest to the peripheral groove 21.

According to another possible embodiment (not shown on the figures), the sealing means can have a maximum height hmax before compression greater than the height at which the collars are disposed on the collector plate, the greater maximum height hmax being determined such that the sealing means in the compressed state is kept away from the ends of the heat exchange tubes through the collars.

Finally, in reference to FIGS. 1, 2 and 7, the cover 15 is described in more detail. It can be a cover 15 in plastic or in aluminum alloy.

The cover 15 can have a substantially general dome shape. In particular, the cover 15 comprises a peripheral cover base 43 closing the collector box 3 by compressing the seal 13. The expression "cover base" means the lower part of the cover 15 abutting against the seal 13 and which cooperates with the collector plate 11 so as to be fastened, for example by means of clamping tabs 16 present on the periphery or surround of the collector plate 11 and which are turned down, when clamping, over the cover 15.

As is more visible on FIGS. 2 and 7, the cover base 43 has a predefined number of protuberances 45 protruding from the inner wall of the cover base 43 and extending towards the seal 13 on the collector plate 11 so as to abut against the seal 13. In particular, the protuberances 45 protrude over a thickness e from the inner wall of the cover base 43. The protuberances 45 are therefore made inside the volume defined by the cover 15.

The thickness e is chosen for example large enough for at least one protuberance 45 of the cover base 43 to abut against a holding portion 31 and/or 33 of the sealing means 13, in the assembled state of the collector box 3.

Furthermore, each protuberance 45 has a lower part 47, which abuts on the sealing means 13 as schematized on FIG. 8. The protuberances 45 are advantageously made in one piece with the cover 15, for example by injection. The protuberances 45 extend in this example substantially parallel to the axis A.

Additionally, according to the illustrated example, the cover base 43 is offset relative to the dome shape of the cover 15. In other words, the cover base 43 makes it possible to define a sill as seen on FIG. 1. The protuberances 45 in this example are aligned with, or in other words arranged in the continuity of the inner wall of this dome shape of the cover 15, as is better seen on FIGS. 2 and 7.

The cover base 43 has a shape complementary to the shape of the peripheral contour of the collector plate 11, substantially rectangular here. The protuberances 45 can be provided on one or both opposite short sides of the cover base 43. As a variant or addition, the protuberances can be provided on one or both opposite long sides of the cover base 43. In particular, a protuberance 45 can be arranged between the end collar 19 and the corner of the collector box 3 (see FIG. 8).

Additionally, in the case of a seal 13 according to the second embodiment, one or more protuberances 45 can abut the holding portion 31 adjacent to the short side 13*b* of the seal 13 while being inserted at a given height in a recess 41 provided for this purpose on the holding portion 31.

These protuberances 45 hold the seal 13 in position and make it possible to prevent the latter from moving or being deformed during assembly but also during the different heat cycles of the heat exchanger 1. The protuberances 45 thus contribute to holding the seal 13 such that it is kept away from the ends of the heat exchange tubes 7. The protuberances 45 can furthermore respectively have a contour reducing the risk of damaging the seal 13 when assembling the collector box 3, for example the corners or edges can be substantially rounded.

Finally, the cover base 43 can have a counter-form 49, visible on FIGS. 2 and 3, such as a rib extending axially towards the cover base 43, so as to abut against the thinned portion 37 of the seal 13 according to the first embodiment. As a variant, the counter-form 49 for a seal 13 according to the second embodiment abuts between a short side 13*b* and the adjacent holding portion 31.

Thus, when assembling the heat exchanger 1, the bundle 5 of heat exchange tubes 7 is brazed on the collector plate 11. The seal 13 is placed on the bottom 11*a* or in the peripheral groove 21 of the collector plate 11, and then the cover 15 is clamped to the collector plate 11, in particular by means of the clamping tabs 16, with the seal 13 inserted between the cover base 43 and the collector plate 11. The seal 13 and in particular its peripheral part 13*a*, 13*b* ensure sealing between the collector plate 11 and the cover 15. Also, the seal 13 abuts against the collars 19 and is arranged away from the ends of the heat exchange tubes 7 passing though the collector plate 11 by interposing the collars 19. In particular, at least one support face 29 of the seal 13 is arranged abutting against a collar 19. There is thus no risk of the seal 13 transmitting the load exerted by the cover 15 on the seal 13 at the ends of the heat exchange tubes 7 emerging in the collector box 3.

Furthermore, the holding portions 31, 33 enable a recovery of force holding the seal 13 tensioned in particular when assembling the cover 15. Furthermore, the seal 13 remains tensioned in the long term so as to ensure sealing throughout the life of the heat exchanger 1.

The protuberances 45 of the cover 15 participate in holding the seal 13 in position without contact with the ends of the heat exchange tubes 7.

The invention claimed is:

1. A collector box for heat exchanger comprising:

a collector plate having a plurality of holes respectively lined by collars for passage of the ends of a plurality of heat exchange tubes;

a compressible sealing means disposed on the peripheral contour of the collector plate; and a cover closing the collector box while compressing the sealing means, wherein the sealing means includes at least one support face and is arranged on the collector plate such that:

said at least one support face is arranged abutting against one of said collars when the sealing means is assembled with the collector plate, the sealing means being furthermore configured to be under tension on the collector plate via the support face, and the sealing means in the compressed state of the sealing means is kept away from the ends of the heat exchange tubes by interposing collars between the sealing means and the ends of said tubes, wherein the collars are protuberant on the collector plate and extend towards an interior of the collector box, and wherein the sealing means has a maximum height before compression less than or equal to a height at which the collars are arranged on the collector plate.

2. The collector box as claimed in claim 1, wherein the sealing means has a peripheral part substantially rectangular in shape, and comprises at least one holding portion extending along the transversal direction and having said at least one support face.

3. The collector box as claimed in claim 2, wherein at least one holding portion having said at least one support face, the holding portion being arranged between two successive collars and has a width substantially equal to the space between the two collars, for example of the order of 2.5 mm to 5 mm.

4. The collector box as claimed in claim 2, wherein said at least one holding portion is made in one piece with the peripheral part of the sealing means.

5. The collector box as claimed in claim 2, wherein at least one holding portion extends transversally so as to connect the two long sides of the sealing means.

6. The collector box as claimed in claim 2, wherein at least one holding portion is made in the form of a lug.

7. The collector box as claimed in claim 2, wherein said at least one holding portion has a flat on its upper face opposite the cover.

8. The collector box as claimed in claim 1, wherein the collector plate extends along a substantially flat surface except for the collars.

9. The collector box as claimed in claim 1, wherein the collector plate comprises a peripheral groove for accommodating at least partially the sealing means.

10. The collector box as claimed in claim 2, wherein the cover comprises a peripheral cover base and wherein the cover base has a predefined number of protuberances protruding from the inner wall of the cover base and extending towards the sealing means on the collector plate so as to abut against the sealing means when the collector plate is assembled with the cover.

11. The collector box as claimed in claim 10, wherein at least one protuberance of the cover base is arranged abutting against said at least one holding portion of the sealing means.

12. A sealing means for a collector box of a heat exchanger, the sealing means comprising:

a peripheral part substantially rectangular in shape disposed on a peripheral contour of a collector plate of the collector box, the collector plate having a plurality of holes respectively lined by collars for passage of the ends of a plurality of heat exchange tubes;

at least one holding portion extending along the transversal direction and having at least one support face configured to be arranged abutting against a collar of the collector plate of the collector box when the sealing means is assembled with the collector plate, wherein the sealing means is elastic so as to be placed under tension on the collector plate via the support face, wherein said at least one holding portion has a maximum height before compression predefined so as to be less than or equal to a height at which said collar is disposed on the collector plate, wherein the collector box comprising a cover for closing the collector box while compressing the sealing means, and wherein the collars are protuberant on the collector plate and extend towards an interior of the collector box.

13. A heat exchanger for motor vehicle, comprising:

a bundle of heat exchange tubes;

at least one collector box comprising:

a collector plate having a plurality of holes respectively lined by collars for passage of the ends of the bundle of heat exchange tubes, a compressible sealing means disposed on the peripheral contour of the collector plate, and a cover closing the collector box while compressing the sealing means, wherein the sealing means:

includes at least one support face arranged abutting against one of said collars when the sealing means is assembled with the collector plate, is configured to be under tension on the collector plate via the support face, and in the compressed state of the sealing means, is arranged away from the ends of said tubes passing through the collector plate by interposing collars, wherein the collars are protuberant on the collector plate and extend towards an interior of the collector box, and wherein the sealing means has a maximum height before compression less than or equal to a height at which the collars are arranged on the collector plate.

14. The heat exchanger as claimed in claim 13, wherein the heat exchanger is assembled by brazing.

* * * * *